US005419591A

United States Patent [19]

Lambert et al.

[11] Patent Number: 5,419,591

[45] Date of Patent: May 30, 1995

[54] COURIER WAYBILL

[75] Inventors: Francois Lambert, Ile Bizard; Thomas J. Goodwin, Trenton; Patrick J. McGilly, Brighton; Claude Debonville, St.-Lazare, all of Canada

[73] Assignee: Moore Business Forms, Inc., Grand Island, N.Y.

[21] Appl. No.: 237,361

[22] Filed: May 3, 1994

[51] Int. Cl.[6] ..... B42D 15/00

[52] U.S. Cl. ..... 283/79; 283/81; 462/18

[58] Field of Search ..... 283/79, 80, 81; 462/2, 462/18, 20, 21, 7

[56] References Cited

U.S. PATENT DOCUMENTS

| | | | |
|---|---|---|---|
| 3,524,271 | 8/1970 | Buske . | |
| 3,524,782 | 8/1970 | Buske . | |
| 3,987,960 | 10/1976 | Gardiner | 283/79 X |
| 4,475,747 | 10/1984 | Ashby . | |
| 4,614,361 | 9/1986 | Foster . | |
| 4,688,826 | 8/1987 | Hosoya . | |
| 4,821,439 | 4/1989 | Wilck . | |
| 4,882,861 | 11/1989 | Holmes et al. | 283/80 X |
| 4,928,874 | 5/1990 | Henry et al. . | |
| 4,995,642 | 2/1991 | Juszak et al. . | |
| 5,002,311 | 3/1991 | Brunjes . | |
| 5,087,223 | 2/1992 | Kaluza | 283/79 X |
| 5,238,272 | 8/1993 | Taylor . | |

FOREIGN PATENT DOCUMENTS 412842 2/1991 European Pat. Off. .

*Primary Examiner*—Willmon Fridie
*Attorney, Agent, or Firm*—Nixon & Vanderhye

[57] ABSTRACT

A multi-ply courier waybill comprises a plurality of data plies connected along et least one marginal edge to an underlying backing ply having a pressure sensitive adhesive applied to the undersurface thereof for attachment to a package to be shipped. The backing ply includes a plurality of die cut labels formed over a portion thereof spaced inwardly from the marginal edges of the backing ply, and the pressure sensitive adhesive is covered by a release liner. Removal of the release liner from the surface of the adhesive will result in removal of the die cut labels from the backing ply. At least some of the data plies and the die cut labels ere provided with common bar code indicia. The labels are applied to satellite packages so that only one waybill can accommodate a number of packages sent to the same addressee.

20 Claims, 4 Drawing Sheets

COURIER WAYBILL

BACKGROUND AND SUMMARY OF THE INVENTION

This application relates to courier waybills, and, in particular, courier waybill assemblies which comprise a plurality of plies or parts, at least one of which is adapted to be adhesively affixed to a package being shipped. Usually such assemblies comprise a minimum of three plies, one of which is retained by the customer shipping the package, one of which will be retained for the records of the carrier or courier service, and the other of which is affixed to the package being shipped.

Usually the waybill comprises more than three plies, as the carrier or courier service will frequently want at least two, one for its permanent records, and one to be used as a control record so that the shipment may be more readily traced from the point of shipment. Further, an extra ply will frequently accompany the package so that it may be initialled by the recipient and removed by the carrier or courier service as evidence of delivery.

In some cases a customer may want to ship more than one package to the same destination, and this necessitates the use of a separate multi-ply waybill for each package, with the result that three or four waybills may have to be completed and secured to the packages, with corresponding numbers of record plies being removed and retained by the customer and the courier service. If all packages are for shipment to the same destination, this results in a good deal of duplication and wastage of both time and forms, and a multiplicity of record copies must be removed and retained by the various parties and usually grouped together to indicate that several packages are included in the same shipment.

Waybills of the type described are usually provided with a backing sheet having a pressure sensitive adhesive on the outer surface thereof, which adhesive is covered by a protective release liner over the entire surface thereof. The release liner is adapted to be peeled from the adhesive surface of the backing sheet to expose the adhesive for direct application of the backing sheet, and components adhered thereto, directly to a package to be shipped.

The need to utilize a plurality of separate waybills for separate satellite or serial packages being shipped at the same time to the same destination may be avoided, according to the invention, if at least some of the plies are provided with machine readable bar code indicia for identification purposes, and if the backing sheet includes a plurality of readily removable (e.g. die cut) labels formed over a portion thereof so that the labels releasably adhere to the release liner, and are automatically removed from the backing sheet with the release liner is the release liner is peeled from the adhesive surface of the backing sheet. Preferably the labels are formed from an interior portion of the backing ply, leaving at least the perimeter thereof undisturbed so that the backing ply, and the portion of the waybill connected thereto, may be securely adhered to the package to be shipped by means of the undisturbed adhesive covered surface of the backing ply. The labels which may, for example, be three or four in number, may then be peeled from the release liner and adhesively affixed to one or more satellite or serial packages being shipped by the same customer at the same time to a common destination. Each label will bear bar code indicia which corresponds to the indicia on other parts of the waybill, so that the packages bearing the labels may be identified and associated with the main package carrying that part of the assembly which travels with the package and which identifies the addressee, the customer initiating the shipment, and pertinent information pertaining thereto.

In addition to the bar coded labels, other labels may also be formed from the backing ply which contain shipping instructions (for example, providing for Saturday delivery, etc.).

In addition to the bar code indicia applied to the labels, the labels may also be identified by number to indicate that the package to which the label is applied is a second, third, or four package, for example, of a group shipment.

The invention also contemplates a method of shipping using the waybill described above. The method comprises the steps of: (a) Separating the release liner from the backing ply, which simultaneously separates the die cut labels from the backing ply, the labels being retained on the release liner. Then (b) applying the pressure sensitive adhesive from the backing ply to a first package being sent to a given address so that the at least one dam ply with common bar code indicia is connected to the package. (c) Removing a label with common bar code indicia thereon from the release liner, and then applying the label with common bar code indicia thereon to a second package being sent to the given address. And, after steps (b) and (c), (d) shipping the first and second packages at the same time using the same carrier.

It is the primary object of the present invention to provide an advantageous waybill—and method of use thereof—for use with satellite packages. This and other objects of the invention will become clear from the detailed description of the invention, and from the appended claims.

DETAILED DESCRIPTION OF THE DRAWINGS

Figure 1:
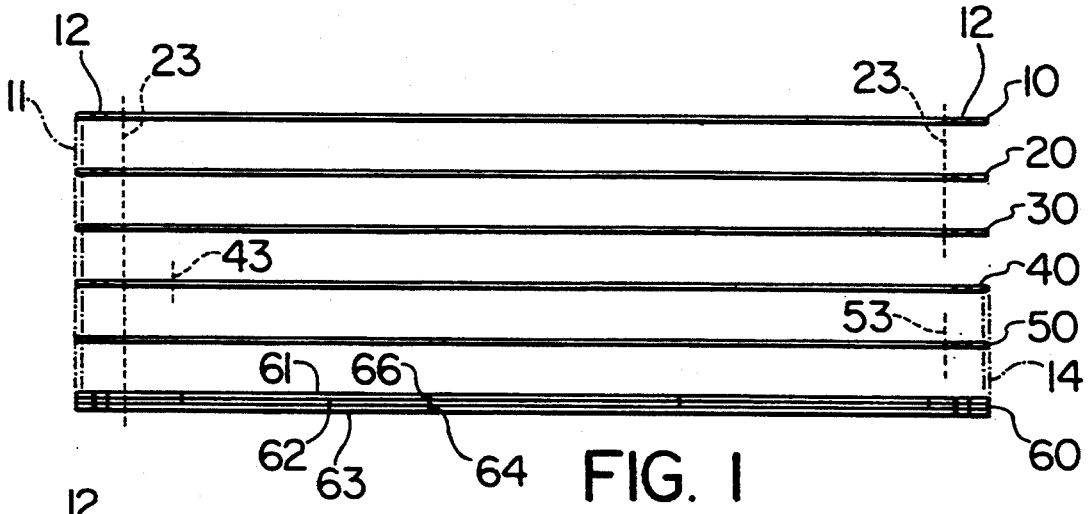
FIG. 1 is an exaggerated, exploded, schematic side view of one embodiment of a courier waybill according to the present invention.
Figure 3:
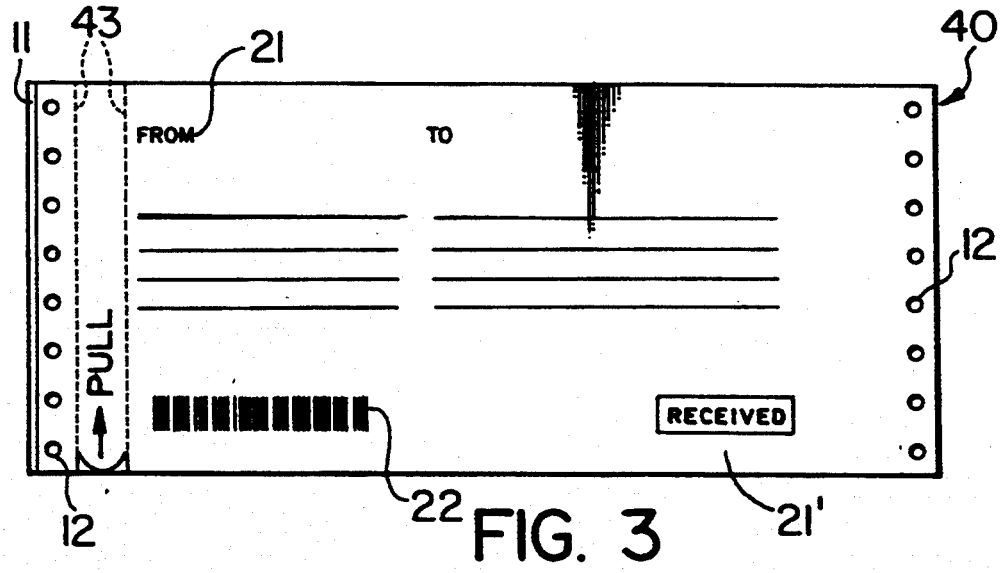
FIG. 3 is a top view of the top delivery information ply on that part of the waybill of FIG. 1 secured to a package.
Figure 4:
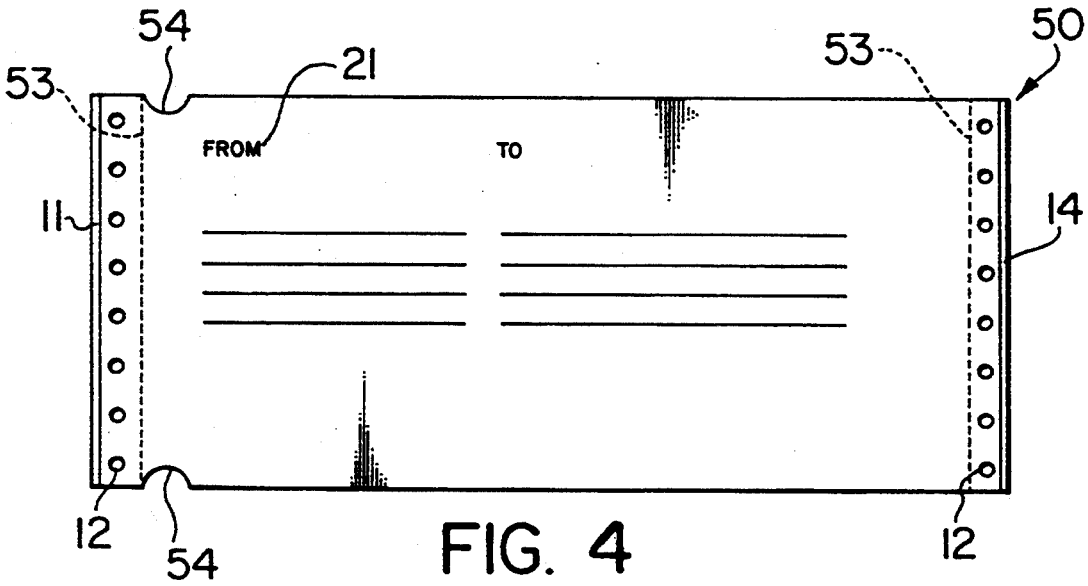
FIG. 4 is a top view of an intermediate delivery information ply on that part of the waybill of FIG. 1 secured to a package.
Figure 5:
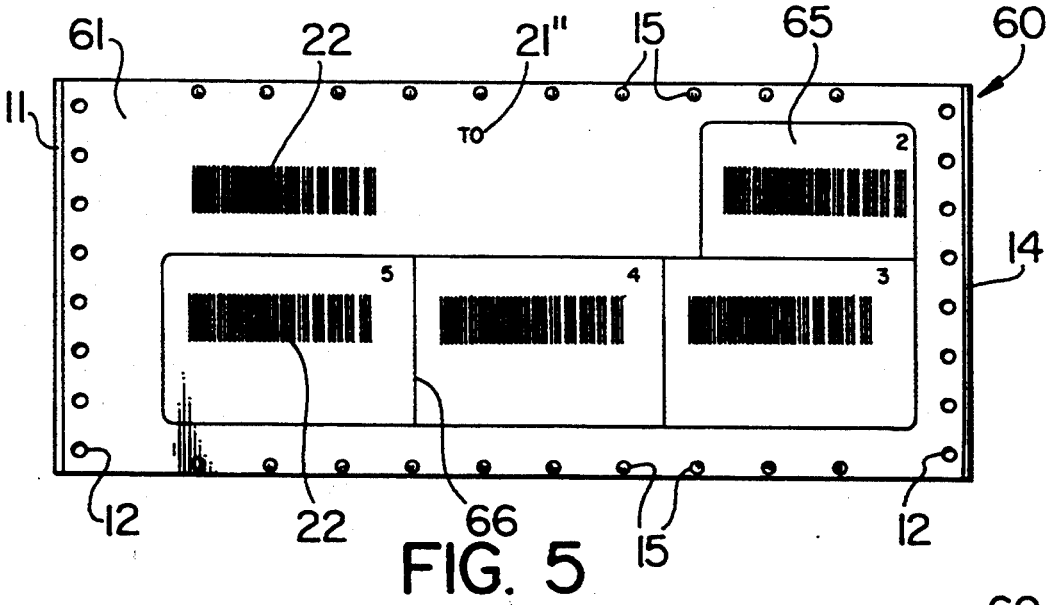
FIG. 5 is a top view of the backing ply of the waybill of FIG. 1.

Referring now to FIGS. 1 through 6, a six part or six ply courier waybill is illustrated. As best illustrated in FIG. 1, the waybill comprises superimposed quadrate plies or paper sheets, identified from top to bottom as 10, 20, 30, 40, 50 and 60. The plies are all secured to one another along the left hand marginal edge by means of adhesive or glue strips 11 and, inboard of each marginal edge, the plies are desirably provided with an array of aligned tractor drive holes 12. The fourth, fifth and sixth plies 40, 50 and 60 are adhesively secured together along the right hand margins by means of adhesive strips 14, and plies 50 and 60 are releasably secured together along their lateral margins by relatively weekly adhering adhesive spots 15 as illustrated in FIG. 5.

Figure 2:
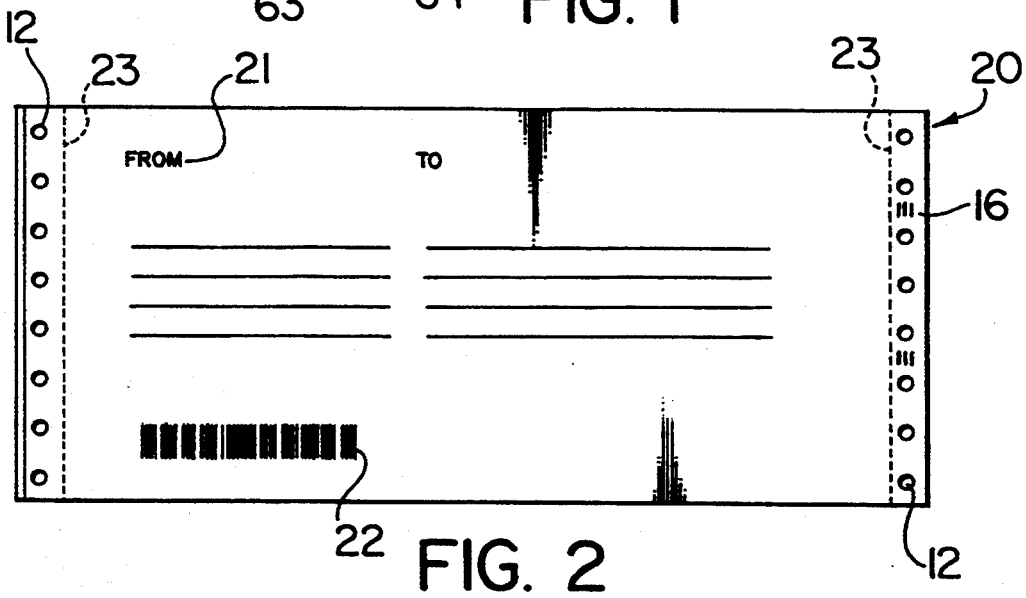
FIG. 2 is a top view of the top record ply of the waybill of FIG. 1.

Plies 10, 20 and 30 are preferably connected together and with the rest of the waybill only along the left hand end as viewed in the drawings, although they may be loosely connected to one another adjacent their right hand margins by means of paper staples illustrated at 16 in FIG. 2.

Except for the appearance of bar code indicia on certain plies required for identification or control purposes, the fixed printed information on plies 10 through 50, which may be referred to generally as "data plies", may be identical. However, bar code indicia (22) may be applied to all plies even though it may be of little or any value on same. As plies 10, 20 and 30 are of the same in construction, the illustration of ply 20 in FIG. 2 also illustrates data plies 10 and 30 which ere identical but for the possible absence of bar code indicia on those plies.

As will be seen from FIG. 2, fixed reprinted indicia 21 is preferably provided for insertion of the information respecting the shipper and the consignee or recipient (addressee), and for insertion of other information pertinent to the shipment, and bar code indicia 22 is provided along the lower margin. Transverse lines of perforations, or perf lines 23, are provided across each end inboard of the tractor feed holes 12 and, as previously noted, the three plies 10, 20 and 30 may be loosely and releasably connected as a group by means of paper staples 16. As will be described below, the data plies 10, 20 and 30 are in the nature of record plies which ere removed at the point of shipment, with one ply normally being retained by the shipper for its records, and two plies being retained by the courier, or carrier with one being used for billing purposes, and the other being retained as a record at the shipping office. The billing record (in the illustrated embodiment ply 20) will normally bear the bar code indicia for identification purposes, although, as previously noted, the bar code indicia may be borne by ell plies.

FIG. 3 illustrates fourth ply 40 which bears the same reprinted indicia 21 as the other plies, and the same bar code indicia 22 as the record ply 20. However, this ply is also secured to the ply 50 and the backing ply 60 by means of adhesive lines 14, and is provided with a tear strip at the left hand end as seen in the drawings defined by transverse parallel perf lines 43 disposed inboard of the tractor feed holes 12. In addition to fixed printed indicia 21, the ply 40 may also be provided with fixed printed indicia 21' for application of the recipients signature or initials to confirm receipt of the package.

Ply 50 contains the same reprinted indicia 21 as the preceding plies as well as perf lines 53 at either end, and inboard of the tractor feed holes 12, which perf lines are in alignment with the perf lines 23 of plies 10, 20 and 30. As noted previously, ply 50 is connected to backing ply 60 by means of adhesive spots 15 along the lateral edges. To facilitate removal, as will hereafter be described, the ply 50 is preferably provided with die cut semicircular chips 54 on each lateral side adjacent to, and inboard of, the left hand perf line 53 as seen in FIG. 4.

Figure 6:
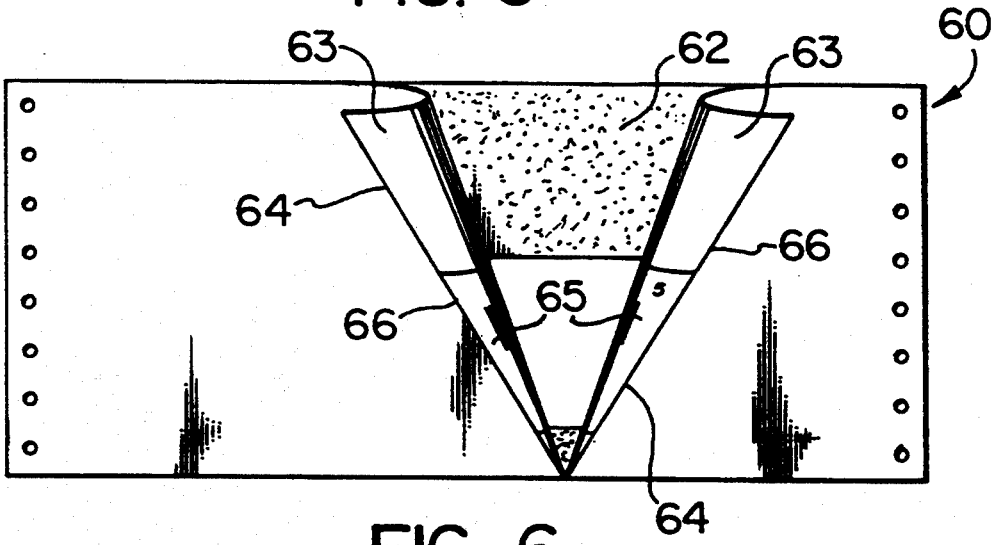
FIG. 6 is a bottom view of the backing ply of the waybill of FIG. 1 illustrating the release liner being peeled therefrom.

The backing ply 60 illustrated in FIGS. 5 and 6, and perhaps best seen in FIG. 1, comprises a paper sheet 61, suitable for label construction, with a pressure sensitive adhesive layer 62 covering the bottom face or surface thereof. A protective release liner 63 overlies the adhesive 62 coated surface of the backing ply 60, and, in a conventional manner, is strippable from that surface to expose the adhesive 62 for application of the backing ply 60 directly to a package. Adhesive spots 15, which may be heat activatable, ere disposed along each lateral margin between adhesive lines 11 and 14, and addressee information block 21" and bar code indicia 22, identical to that appearing on at least plies 20 and 40 are printed on the top of the backing sheet. Additionally, a plurality of readily removable (e.g. die cut) labels 65 ere formed in the adhesive backed sheet 61, which labels are printed, inter alia, with bar code indicia 22 identical to that used elsewhere. As seen in FIG. 1, the release liner 63 is also preferably provided with a transverse slit 64 which is in alignment with the die cut 66 between two adjacent labels 65 (see FIG. 5).

As it is desirable that variable information (e.g. addressee information) printed on the top ply 10 be transferred to the subsequent plies 20, 30, 40, 50, and 60, conventional transfer means—such as interleaved carbon plies may be interposed between the various assembly plies, or, alternatively, pressure sensitive image transfer systems such as CF-CB (coated front-coated back) transfer means—may be utilized to effect indicia transfer. For example ply 10 may be CB, plies 20, 30 and 40 CF-CB, and ply 50, CF and part CB, and ply 60 part CF, the latter to transmit addressee information. Accordingly, when the courier waybill assembly is utilized, the name and address of the sender, the name and address of the addressee or recipient, and other relevant information respecting the shipment may be entered on the top ply 10, and this information will be transferred to the subsequent plies 20, 30, 40, and 50 which, as previously indicated, contain the same fixed printed indicia 21. By means of selectively utilized transfer means, addressee information may also be transferred to ply 60.

After entry of the relevant variable data, the top three plies 10, 20 and 30 of the waybill are snapped off by firmly grasping the free unadhered ends to the right hand side of FIG. 1, and separating the plies from the remainder of the assembly along the perf lines 23 at the left hand end of the assembly as viewed in FIG. 1. The stub at the free end containing the tractor holes 12 may be removed by tearing off along perf lines 23 inboard the tractor holes, and these three plies may therefore be used as record copies by the person sending the package, and by the courier or carrier who will normally retain two copies, including that comprising ply 20 containing the bar code indicia 22. The remainder of the waybill is bent slightly about slit 64 so that the release liner 63 may be grasped and peeled from the adhesive surface of the backing ply 60, and the backing ply 60 is then adhered, by means of the exposed adhesive 62, to one of the packages being shipped so that plies 40, 50 and backing ply 60 are firmly affixed to the package.

The die cut labels 65 are removed with the release liner 63 automatically as it is peeled from the adhesive surface of the backing sheet. The labels 65 may then individually be removed from the release liner 63 and applied to one or more separate satellite or serial packages being shipped by the same customer to the same destination at the same time. These serial packages will all be identified as being associated with the package bearing the backing sheet 60 and remainder of the waybill by means of the bar coded indicia 22 which is common to all packages.

When the packages reach their destination, they can be assembled by means of the bar code indicia 22 thereon and receipt can be acknowledged by the recipient by initialling or signing ply 40 at 21', and ply 40 can then be removed by means of the tear strip or zipper strip and peeling or tearing the ply off the adhesive connection at the right hand end. If the recipient wishes to retain a record upon receipt of the package, ply 50 can be removed from the backing ply 60 by slipping a pen or pencil under the die cut chip 54 in the lower left corner and peeling it in counter clockwise fashion off the adhesive spots 15 and separating it from the backing ply 60 along perf lines 53.

A second embodiment of e courier waybill assembly according to the present invention is depicted in FIGS. 7 through 12. This embodiment consists of a six ply assembly comprising, from top to bottom, plies 110, 120, 130, 140, 150 and 160. All plies are interconnected along the left hand margin as viewed in FIG. 7 by means of adhesive lines 111, and plies 110, 120, 130, 140 and 150 are connected along the right hand margin when viewed in FIG. 7 by lines of adhesive 114. Each ply is provided along the left hand. margin, inboard of adhesive lines 111, with an array of tractor drive holes 123, and similar tractor drive holes 123 are provided along the right hand margin of plies 110, 120, 130, 140 and 150. The plies 110, 120, 130, 140 and 150 are of equal length and are all longer than backing ply 160 so that they overlie, but extend beyond the right hand margin of ply 160.

Figure 8:
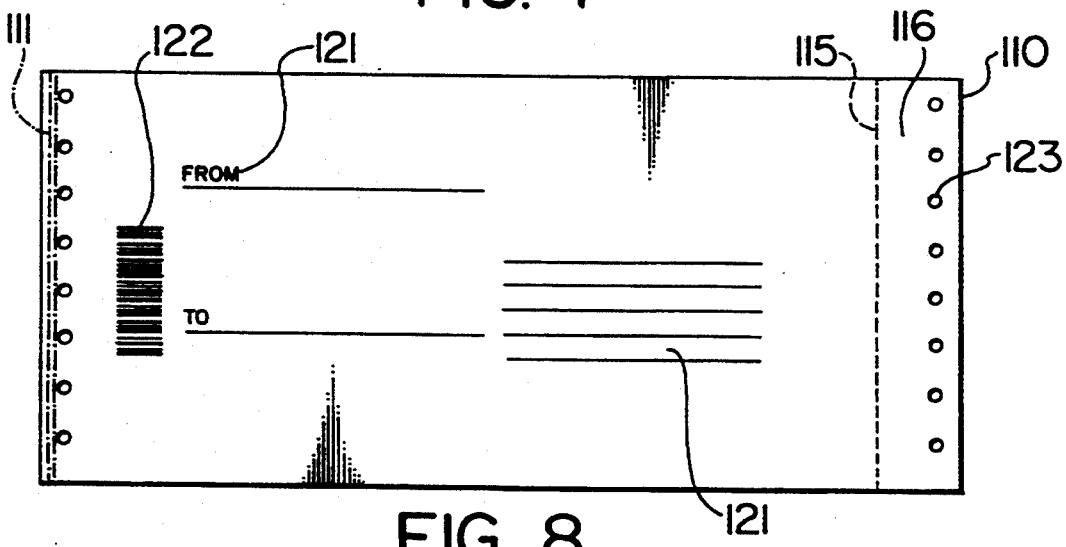
FIG. 8 is a top view of the top ply of the waybill of FIG. 7.

The top ply 110 is equal in width to the bottom ply 160 and, as depicted in FIG. 8, is provided with a transverse line of perforations or perf line 115 in alignment with the right hand end of the bottom ply 160. This permits ready separation of the outboard stub portion 116 of the ply from the remainder thereof. The top of the ply is provided with reprinted indicia 121 for insertion of information respecting the shipper, the consignee, and other information pertinent to the package delivery, and is also provided with bar code indicia 122. The reprinted indicia 121 is reproduced on all plies 110 through 150, and the bar code indicia 122 is reproduced on ply 150, and at least one of plies 120, 130 and 140.

Figure 11:
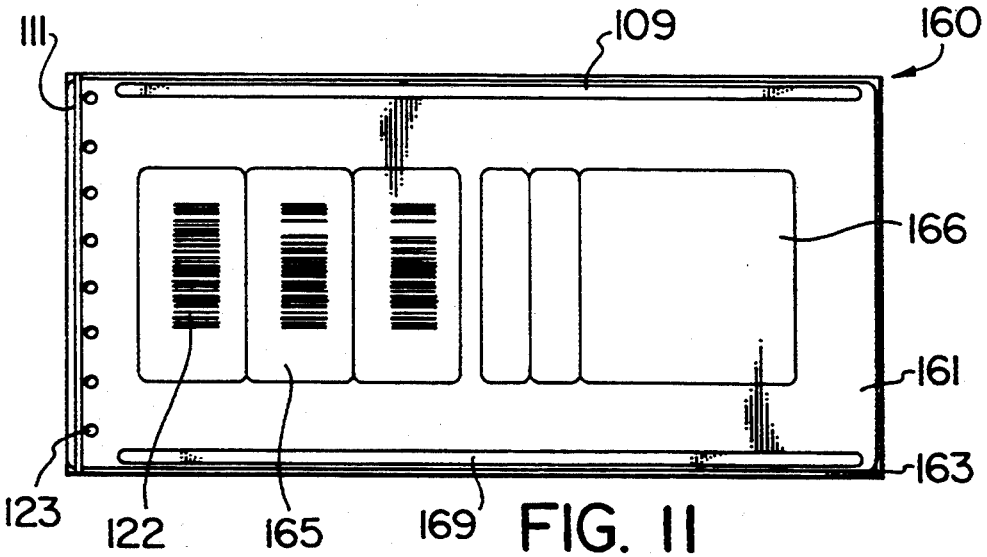
FIG. 11 is a top view of the backing ply of the waybill of FIG. 7.

Top ply 110 is releasably secured along its lateral marginal edges to bottom ply 160 through adhesive lines 169 as seen in FIG. 11. The adhesive employed in such that the portion of ply 110 adhered to the bottom ply 160 may be pealed therefrom for complete separation if desired.

Figure 9:
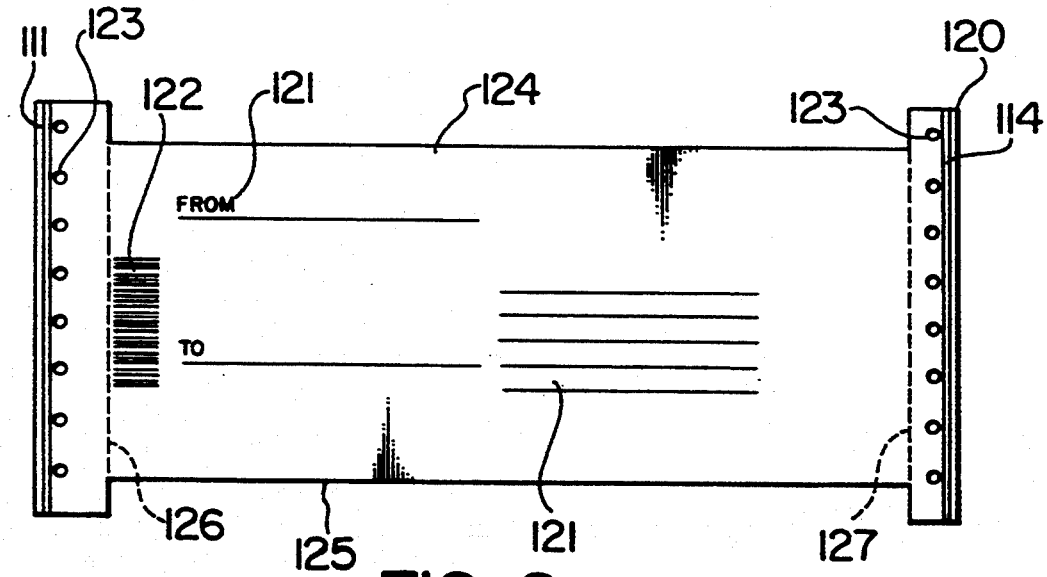
FIG. 9 is a top view of the second ply of waybill of FIG. 7.

Plies 120, 130 and 140 ere virtually identical in form, and for simplicity, ply 120 only is illustrated in FIG. 9. This ply bears the same bar code indica 122 and the same reprinted indicia 121 as top ply 110, and the top and bottom edges are die cut at 124 and 125 respectively so that, except for the end stub portions, the ply 120 is narrower than the top and bottom plies 110 and 160 ply 120 is provided adjacent the left hand end with a perforation line 126 which defines a left hand stub portion, and permits easy separation of the remainder of the form from the stub portion. The ply 120 is also provided with a transverse perforation line 127 to define a right hand stub portion and permit removal of the remainder of the ply therefrom.

Figure 10:
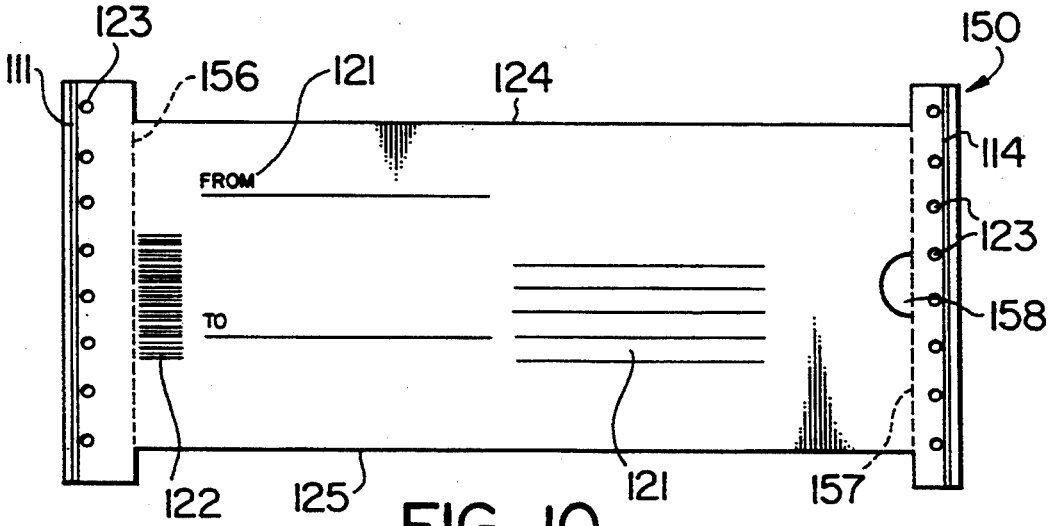
FIG. 10 is a top view of the ply of the FIG. 7 waybill overlying the backing ply.

Ply 150 is depicted in FIG. 10, and is identical in form with plies 120 through 140 expect that it is provided with a line of perforations 157 which defines a right hand stub portion, and permits relatively easy separation of the stub portion from the remainder of the form; it is provided with a transverse line of perforations 156 which defines a left hand stub portion, and permits less ready separation of the remainder of the form from this stub portion. A die cut semicircular chip 158 has been removed from the portion of the ply inboard of perf line 157. The ply 150, being identical in shape to plies 120 through 140, is also narrower in width then plies 110 and 160, with the result that the lateral marginal edges of ply 110 as viewed in FIG. 8 may be secured along lines of adhesive 169 to the top and bottom marginal edges of ply 160.

Figure 7:
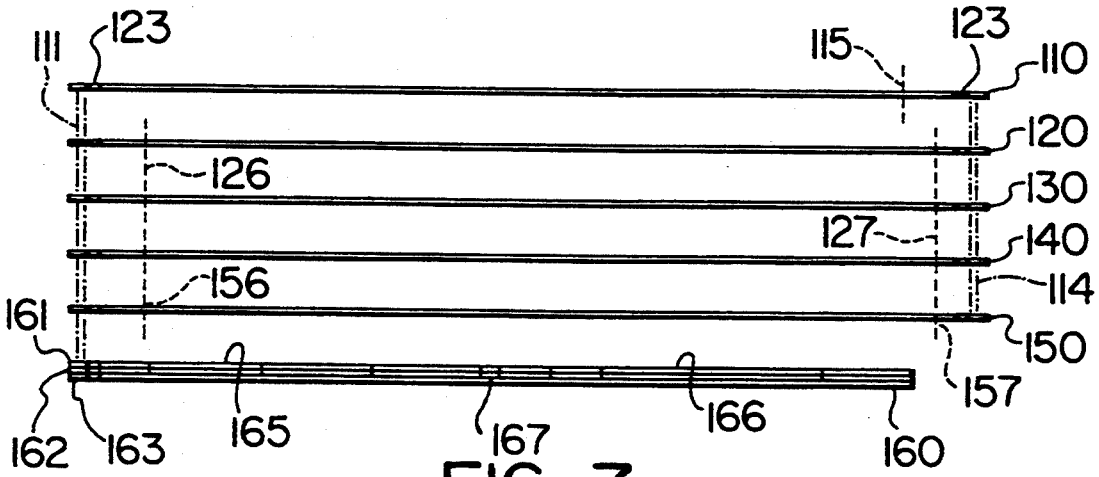
FIG. 7 is an exaggerated exploded schematic side view of another embodiment of a courier waybill of the invention.
Figure 12:
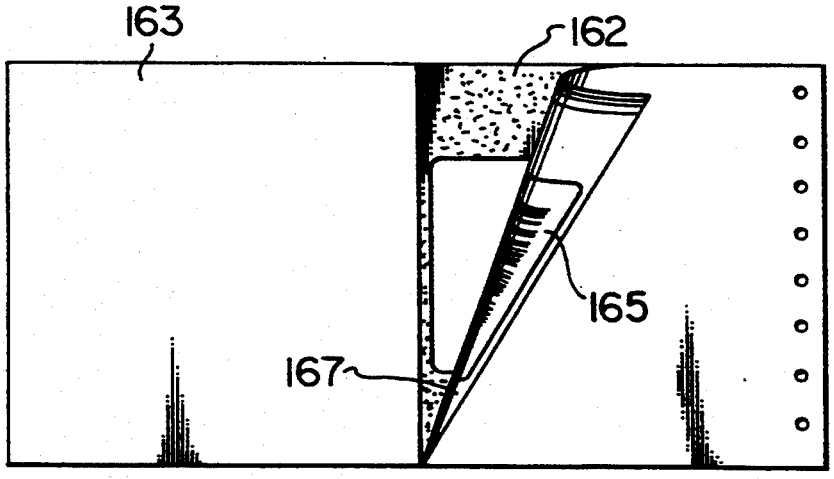
FIG. 12 is a bottom view of the backing ply of the waybill of FIG. 7 showing the release liner being peeled therefrom.

The bottom or backing ply 160 as shown in exaggerated form in FIG. 7, consists of a sheet of label stock 161 having a pressure sensitive adhesive coating 162 over the lower surface thereof. A release liner 163 covers the entire adhesive coated surface. The label stock 161 has a group of die cut labels 165 formed in a portion thereof inwardly of the perimeter of the ply, each of the labels 165 bearing bar code indicia 122 identical to that appearing one the other plies. The ply 160 is also provided with a second group of die cut labels 166, disposed on a portion inboard of the perimeter of the form and spaced from the label group 165, which labels 166 do not bear bar code indicia, but, rather, bear specific delivery instructions or the like. The release liner 163 is provided with e transverse slit 167, disposed between the two groups of labels 165, 166, to permit the release liner 163 to be readily peeled from the adhesive surface 162 as illustrated in FIG. 12.

In this embodiment, the top ply 110 comprises a delivery information ply which travels with the package, whereas plies 120, 130 and 140 comprise record plies for the carrier and the shipper, and ply 150 constitutes e delivery information ply which will normally travel with the package and be removable upon delivery.

In use, variable information is printed on the top ply 110 to identify the shipper of the package, the package consignee, and other information pertinent to the delivery, and, by virtue of an image transfer system such as a CF-CB, or interleaved carbon sheet, the information is transferred to the underlying plies 120 through 150 (and 160 is desired). The top ply 110 is then separated from right hand stub portion along perf line 15, and the right hand stub portion is firmly grasped and snapped to the right as viewed in FIG. 7 to effect removal of plies 120, 130 and 140 along perf lines 126. The ply 150 is not similarly removed because the ply is more readily separable from the right hand stub along perf line 157 than from the left hand stub along perf line 156 and because of the die cut chip 158 the body of the ply is not grasped by the fingers of the user. The stub is therefore separated from the remainder of ply 150, and the ply remains secured to the bottom ply 160 and the top ply 110, and is disposed within the open sided envelope formed by the top and bottom plies as a result of lines of adhesion 111 and 169 (see FIG. 11).

Plies 120, 130 and 140 may the be separated from the stub portion along perf lines 127 and retained by either the carrier or the shipper.

The release liner 163 is then pealed from the adhesive surface to both expose the adhesive 162 for application of the remainder of the courier waybill assembly to a package, and to automatically remove the die cut labels 165, 166 which adhere to the release the release liner. The die cut labels 165 bearing the bar code indicia 122 may then be secured to serial or satellite packages accompanying the main package to which the waybill is applied, and the labels 166 containing special delivery instructions may be removed from the release liner, if required, and applied to the principal package carrying the waybill. The packages are identified as a group by means of the common bar coding 122 visible thereon, with the result that separate waybills are not required for each satellite or serial package.

It will be apparent that various numbers of bar code labels may be produced in either embodiment of the invention and that some or no special delivery instruction labels may be provided with either embodiment. It will also be apparent that the waybills are designed for production in a continuous strip employing the tractor feed holes 12. Only one representative assembly is illustrated for simplicity. However, a continuous array of such assembles may be produced and separated along perforation lines which ultimately form the lateral margins of the individual waybills. Various modifications of the invention will be apparent to those skilled in the art without departing from the scope of the invention. For example, the numbers of plies may vary, and bar code indicia may be provided on ell plies rather than merely selected plies for which bar code indicia is required for control and tracking purposes, etc.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A multi-ply waybill comprising:

a rectangular backing ply having first and second faces and marginal edges;

a pressure sensitive adhesive covering said first face of said backing ply;

a release liner covering said pressure sensitive adhesive and readily releasably adhered thereto;

a plurality of labels formed by a portion of said backing ply, and readily separable therefrom, on a portion thereof spaced inwardly from said marginal edges and mounted so that they are removed from association with said backing ply when said release liner is detached from said backing ply;

at least two data plies bearing common fixed indicia thereon and having marginal edges;

said data plies being connected to each other and to said backing ply adjacent a marginal edge of each, so that said data plies are in a stack overlying said second face of said backing ply; and at least two of said data plies and at least one of said labels having common bar code indicia thereon.

2. A multi-ply waybill as recited in claim 1 wherein said labels comprise rectangular labels disposed contiguously on said backing ply and having marginal edges thereof parallel to said marginal edges of said backing ply.

3. A multi-ply waybill as recited in claim 2 wherein said data plies are connected to each other and to said backing ply by adhesive adjacent a marginal edge of each.

4. A multi-ply waybill as recited in claim 1 wherein said labels are die cut from said backing ply.

5. A multi-ply waybill as recited in claim 3 further comprising a transverse cut dividing said release line at an intermediate position thereof, said transverse cut in alignment with a die cut separating two of said contiguous labels.

6. A multi-ply waybill as recited in claim 2 comprising five data plies; and wherein the two of said data plies closest to said backing ply are connected to said backing ply by a line of adhesive along a first marginal end edge thereof.

7. A multi-ply waybill as recited in claim 6 wherein the other three of said data plies are connected to each other by a line of adhesive along a second marginal edge thereof opposite said first marginal edge; and further comprising a transverse line of weakness parallel to and spaced inwardly from said line of adhesive adjacent said second marginal edge.

8. A multi-ply waybill as recited in claim 7 wherein the data ply immediately overlying said backing ply is releasably adhered to said backing ply along lateral marginal edges extending between said first and second marginal edges, and is provided with transverse lines of weakness adjacent to, and parallel with, said marginal edges and spaced inwardly from the line of adhesive connecting said data ply immediately overlying said backing ply to said backing ply.

9. A multi-ply waybill as recited in claim 8 wherein the second data ply from said backing ply comprises at least one transverse line of perforations adjacent a marginal edge and spaced inwardly from said line of adhesive along said second marginal edge; and wherein said second data ply from said backing ply is provided with a tear strip composed of two parallel transverse lines of perforations adjacent a marginal edge and disposed inwardly of said line of adhesive along said second marginal edge.

10. A multi-ply waybill as recited in claim 1 wherein said plurality of labels comprise two spaced groups of a plurality of contiguous labels, the labels of one of said groups having common bar code indicia thereon, and the labels of the other of said groups having other indicia thereon.

11. A multi-ply waybill as recited in claim 10 wherein said release liner is separated transversely by a die cut parallel with said first marginal edge and disposed between said two groups of labels.

12. A multi-ply waybill as recited in claim 11 wherein each label group comprises three labels.

13. A multi-ply waybill as recited in claim 12 wherein said at least two data plies comprise five data plies interconnected by a line of adhesive along a marginal edge thereof to a marginal edge of said backing ply.

14. A multi-ply waybill as recited in claim 11 wherein the top data ply remote from said backing ply is of equal width to said backing ply and the remaining data plies are of lesser width than said top ply; and wherein said remaining data plies have lateral marginal edges that are spaced inwardly from the corresponding marginal edges of said top ply and said backing ply.

15. A multi-ply waybill as recited in claim 14 wherein the lateral marginal edges of said top ply are releasably adhered to the lateral marginal edges of said backing ply so as to form an open ended envelope therewith; and wherein said top ply is provided with a transverse line of perforations aligned with a marginal end edge of said backing ply.

16. A multi-ply waybill as recited in claim 15 wherein the data plies between said top ply and said backing ply are provided with transverse lines of perforations adjacent marginal edges thereof and parallel thereto; and wherein the data ply adjacent said backing ply is provided with a cut out chip extending from the line of perforations adjacent a marginal edge and extending inwardly therefrom to overlie an adjacent edge of said backing ply.

17. A multi-ply waybill as recited in claim 1 further comprising image transfer means associated with said data plies so that the application of variable data to the top data ply is transferred to underlying data plies.

18. A multi-ply waybill as recited in claim 17 further comprising image transfer means associated with at least a portion of said backing ply so that variable indicia applied to at least a predetermined portion of a top data ply will be transferred to said backing ply.

19. A method of shipping packages using a multi-ply waybill having a backing ply with a pressure sensitive adhesive covered first face covered by a release liner, a plurality of labels formed in the backing ply, a plurality of dam plies with common indicia disposed in a stack covering a second face of the backing ply, and common bar code indicia provided on at least one of the labels and at least one of the data plies, comprising the steps of:

(a) separating the release liner from the backing ply, which simultaneously separates the die cut labels from the backing ply, the labels being retained on the release liner; then (b) applying the pressure sensitive adhesive from the backing ply to a first package being sent to a given address so that the at least one data ply with common bar code indicia is connected to the package;

(c) removing a label with common bar code indicia thereon from the release liner, and then applying the label with common bar code indicia thereon to a second package being sent to the given address; and after steps (b) and (c), (d) shipping the first and second packages at the same time using the same carrier.

20. A method as recited in claim 19 wherein common bar code indicia is provided on at least two of the labels and wherein step (c) is practiced to remove at least two labels with common bar code indicia thereon from the release liner and applying a different label with common bar code indicia to second and third packages being sent to the given address; and wherein image transfer means are provided between the data plies, and between the data ply and the backing ply; and comprising the further step, prior to step (a), of impressing indicia on the top data ply including address indicia, at least part of the indicia being transferred from the top ply to all of the data plies and the backing ply by the image transfer means.

* * * * *